US006739161B2

(12) United States Patent
Ohara et al.

(10) Patent No.: US 6,739,161 B2
(45) Date of Patent: May 25, 2004

(54) CLEANING MATERIAL AND SEALING MATERIAL FOR MICROSCOPIC PARTICLES

(75) Inventors: Yasuyuki Ohara, Chiryu (JP); Masaru Nakayama, Chiryu (JP)

(73) Assignee: Tsuchiya TSCO Co., Ltd. (JP)

( * ) Notice: Subject to any disclaimer, the term of this patent is extended or adjusted under 35 U.S.C. 154(b) by 62 days.

(21) Appl. No.: 10/255,986

(22) Filed: Sep. 26, 2002

(65) Prior Publication Data

US 2003/0066317 A1 Apr. 10, 2003

(30) Foreign Application Priority Data

Sep. 27, 2001 (JP) ..... 2001-298334

(51) Int. Cl.[7] ..... D04B 21/02; G03G 15/08

(52) U.S. Cl. ..... 66/194; 66/170; 399/103

(58) Field of Search ..... 66/169 R, 170, 66/190, 191, 192, 193, 194, 195, 202; 399/102, 103, 104, 105, 106; 442/304, 319

(56) References Cited

U.S. PATENT DOCUMENTS

| | | | | | |
|---|---|---|---|---|---|
| 1,501,784 | A | * | 7/1924 | Kingman | 66/195 |
| 4,043,142 | A | * | 8/1977 | Marshall | 66/169 |
| 4,614,094 | A | * | 9/1986 | Kakihana et al. | 66/195 |
| 4,712,281 | A | * | 12/1987 | Scheller | 66/169 |
| 4,888,229 | A | * | 12/1989 | Paley et al. | 66/195 |
| 5,229,181 | A | * | 7/1993 | Daiber et al. | 66/147 |
| 5,271,983 | A | * | 12/1993 | Ise et al. | 428/92 |
| 5,503,892 | A | * | 4/1996 | Callaway | 66/169 |
| 6,115,566 | A | | 9/2000 | Ohara et al. | 399/103 |

FOREIGN PATENT DOCUMENTS

| | | |
|---|---|---|
| JP | 64-026876 | 1/1989 |
| JP | 2-58773 | 4/1990 |
| JP | 6-16963 | 3/1994 |
| JP | 11-061101 | 3/1999 |
| JP | 3065136 | 10/1999 |

* cited by examiner

*Primary Examiner*—Danny Worrell
(74) *Attorney, Agent, or Firm*—Madson & Metcalf

(57) ABSTRACT

A cleaning material or a sealing material is attached to a supporting body facing a moving body that contacts microscopic particles. The cleaning material or the sealing material has a ground fabric formed with a knit fabric. The knit fabric is obtained through warp knitting ground yarns. Pile yarns are raised on the ground fabric. The pile yarns slide on the moving body to scrape off the microscopic particles on the moving body, thereby cleaning the surface of the moving body. The pile yarns also blocks flow of microscopic particles through the space between the moving body and the supporting body and collect the particles.

31 Claims, 7 Drawing Sheets

CLEANING MATERIAL AND SEALING MATERIAL FOR MICROSCOPIC PARTICLES

BACKGROUND OF THE INVENTION

The present invention relates to a cleaning material that removes microscopic particles such as toner and paper powder from a cleaning member, a developing member, a transferring members, which are provided about a photosensitive drum in an electrophotography apparatus, and to a sealing material that blocks flow of microscopic particles.

Typical cleaning material and sealing material are formed by raising a plurality of pile yarns on a ground fabric. A supporting layer is adhered to the back of the ground fabric with an adhesive film. A sticking layer is formed on the back of the supporting layer. The ground fabric is formed of woven fabric, which is obtained by weaving warps and wefts, which are perpendicular to each other. The pile yarns are woven to the wefts.

The cleaning material and the sealing material attached to a housing, which includes a cleaning member, a developing member, and a transferring member, such that the distal ends of the pile yarns contact a photosensitive drum. The cleaning material scrapes toner off the photosensitive drum to clean the surface of the photosensitive drum. The pile yarns of the sealing material trap toner that would otherwise escape from the space between the housing and the photosensitive drum. In other words, the sealing material blocks leakage of the toner from the space.

When such cleaning material and sealing material are cut to fit the shape and the size of an area to which the members are attached, the ground fabric is cut along the direction of the warps and wefts. At this time, the warps and wefts are frayed at the cut surface. Therefore, segments of the warps and wefts and segments of pile yarns can come off the fabric. The dropped segments, or lint, hinder the cleaning and flow blocking performances of the cleaning material and the sealing material.

SUMMARY OF THE INVENTION

The present invention was made for solving the above problems in the prior art. Accordingly, it is an objective of the present invention to provide a cleaning material and a sealing material for microscopic particles that prevent yarns from being frayed by cutting.

To achieve the foregoing and other objectives and in accordance with the purpose of the present invention, a cleaning material attached to a supporting body facing a moving body that contacts microscopic particles is provided. The cleaning material includes a ground fabric and pile yarns. The ground fabric is formed with a knit fabric. The knit fabric is obtained through warp knitting ground yarns. The pile yarns are raised on the ground fabric. The pile yarns slide on the moving body to scrape off the microscopic particles on the moving body, thereby cleaning the surface of the moving body.

The pile yarns of the cleaning material may be formed of conductive fibers.

The present invention may be applied to a method for manufacturing a cleaning material that includes a ground fabric and pile yarns. The pile yarns are raised and then sheared such that the height of the pile yarns from the surface of the ground fabric is 0.5 to 5 mm.

Further, the present invention may be applied to a sealing material attached to a moving body that contacts microscopic particles or to a supporting body facing the moving body. The sealing material has a ground fabric. A supporting layer made of cushioning material is located on the back surface of the ground fabric.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A cleaning material for cleaning microscopic particles according to a first embodiment of the present invention will now be described. The cleaning material is used in an electrophotography apparatus. The structure of the electrophotography apparatus will be described first.

Figure 4:
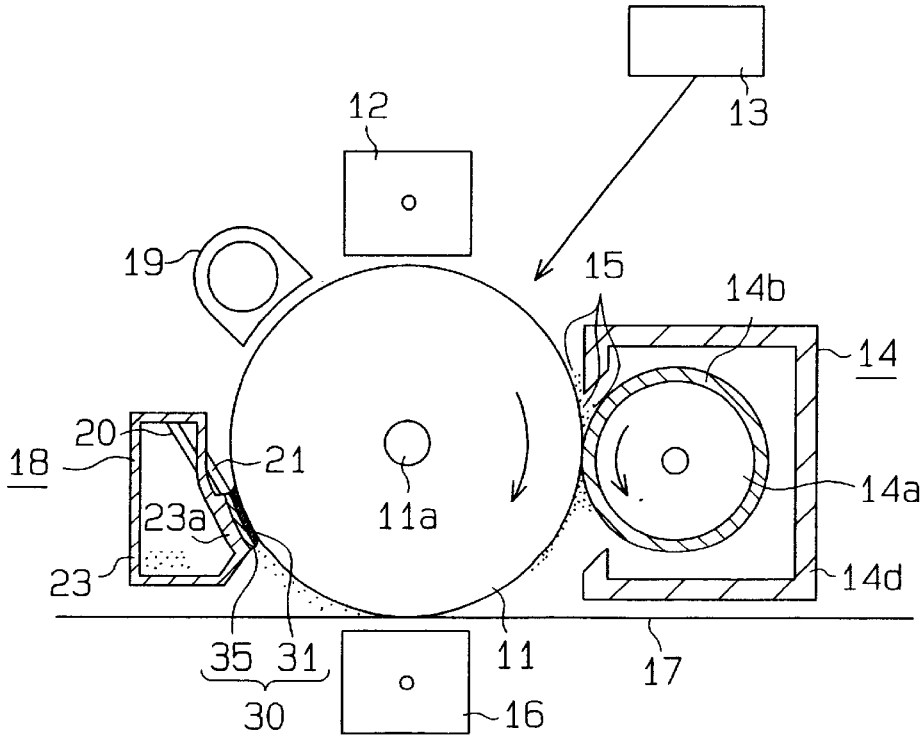
FIG. 4 is a schematic view showing an electrophotography apparatus according to the first embodiment.

FIG. 4 is a schematic view showing the electrophotography apparatus. The electrophotography apparatus has a moving body, which is a photosensitive drum 11 in this embodiment. The photosensitive drum 11 is rotatably supported by a supporting shaft 11*a*. The surface of the drum 11 is capable of being charged. Along the rotation direction of the photosensitive drum 11, a charging member 12, an exposing member 13, a developing member 14, a transferring member 16, a cleaning member 18, and an eraser 19 are arranged about the drum 11. When the photosensitive drum 11 is rotated, the charging member 12 charges the surface of the drum, and the exposing member 13 forms an electrostatic latent image on the surface of the drum 11. Thereafter, the developing member 14 provides the surface with microscopic particles, which is toner 15 in this embodiment. Then, a visible image formed by the toner 15 is transferred from the transferring member 16 onto a recording paper sheet 17, which is provided between the photosensitive drum 11 and the transferring member 16. Thereafter, the cleaning member 18 removes the toner 15 that remains on the surface of the photosensitive drum 11. The charge remaining on the surface of the drum 11 is removed by the eraser 19.

Figure 5A:
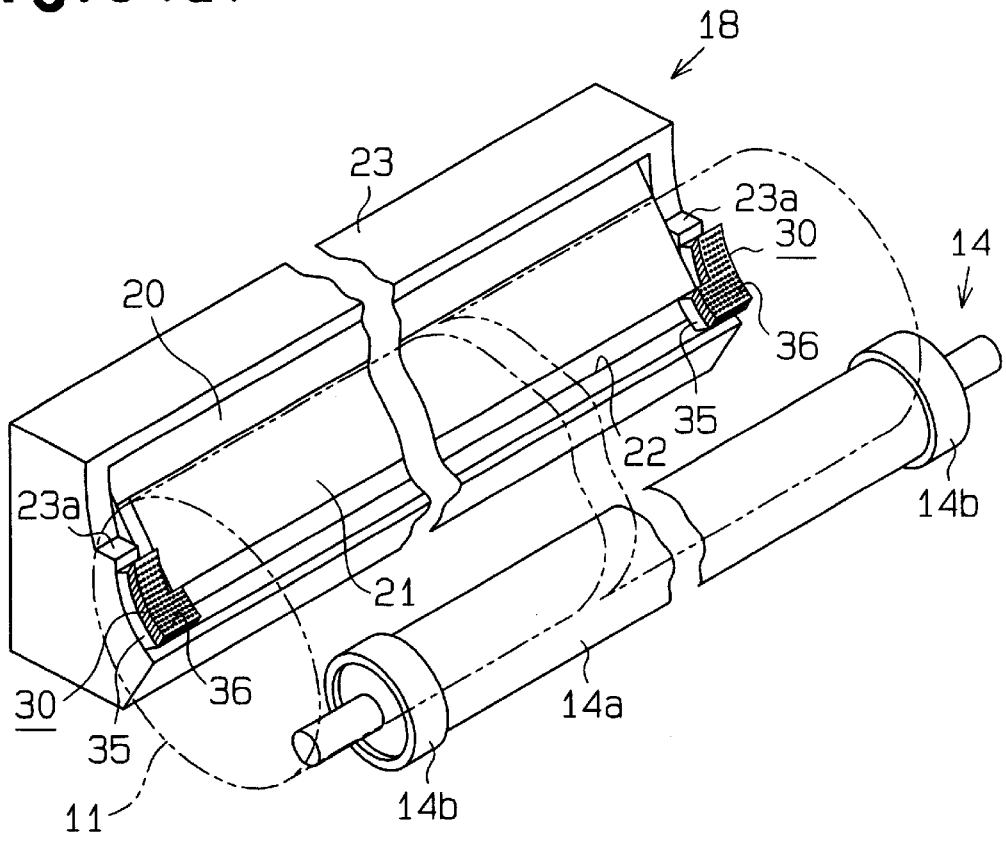
FIG. 5(*a*) is a perspective view showing a state in which velour material contacts a photosensitive drum, FIG. 5(*b*) is a plan view showing a state in which velour material contacts a photosensitive drum.
Figure 5B:
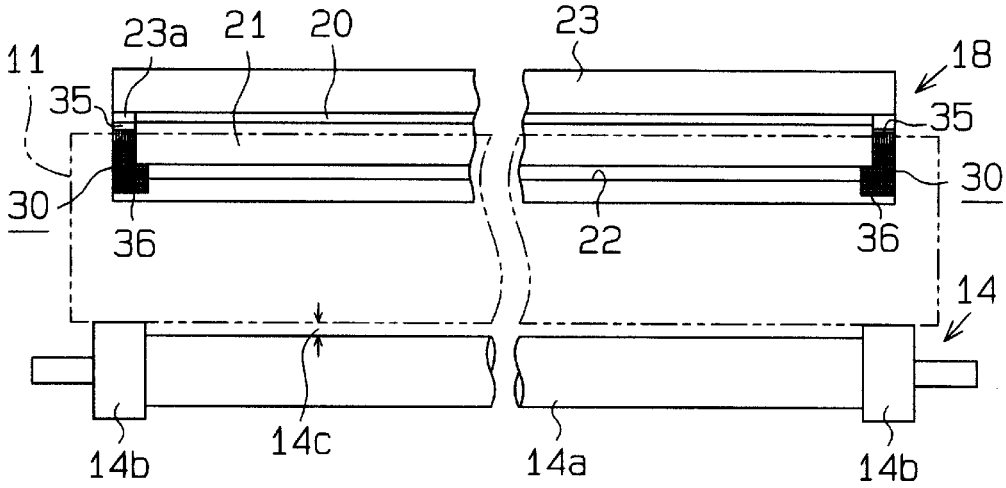

As shown in FIGS. 4, 5(*a*), and 5(*b*), the developing member 14 includes a housing 14*d*. The housing 14*d* is shaped as a box with the opened front side. A developing roller 14*a* is rotatably supported in the housing 14*d*. A cylindrical space retaining cap 14*b* is fitted to each end of the developing roller 14*a*. The outer diameter of each cap 14*b* is greater than that of the diameter of the developing roller 14*a*. Since the space retaining caps 14*b* contact the surface of the photosensitive drum 11, the developing roller 14*a* is separated from the photosensitive drum 11. Accordingly, a space 14*c* exists between the surface of the developing roller 14*a* and the surface of the photosensitive drum 11. The toner 15 on the surface of the developing roller 14*a* is moved onto the surface of the photosensitive drum 11 through the space 14*c* by static electricity.

The cleaning member 18 includes a supporting body, which is a housing 23 in this embodiment. The housing 23 is shaped as a box with the opened front side. A cleaning blade 21 is bendably supported by the housing 23 with a supporting plate 20. The toner 15 remaining on the surface of the photosensitive drum 11 is scraped off by the distal edge of the cleaning blade 21. A toner recovery passage 22 is formed between the distal edge of the cleaning blade 21 and the bottom of the opening of the housing 23. The scraped toner 15 is recovered into the housing 23 through the recovery passage 22. A projection 23*a* is formed in each side of the front face of the housing 23. A space exists between each projection 23*a* and the photosensitive drum 11. An L-shaped piece of cleaning material 30 is attached to each projection 23*a* to fill the space.

The structure of the cleaning material 30 will now be described.

Figure 1:
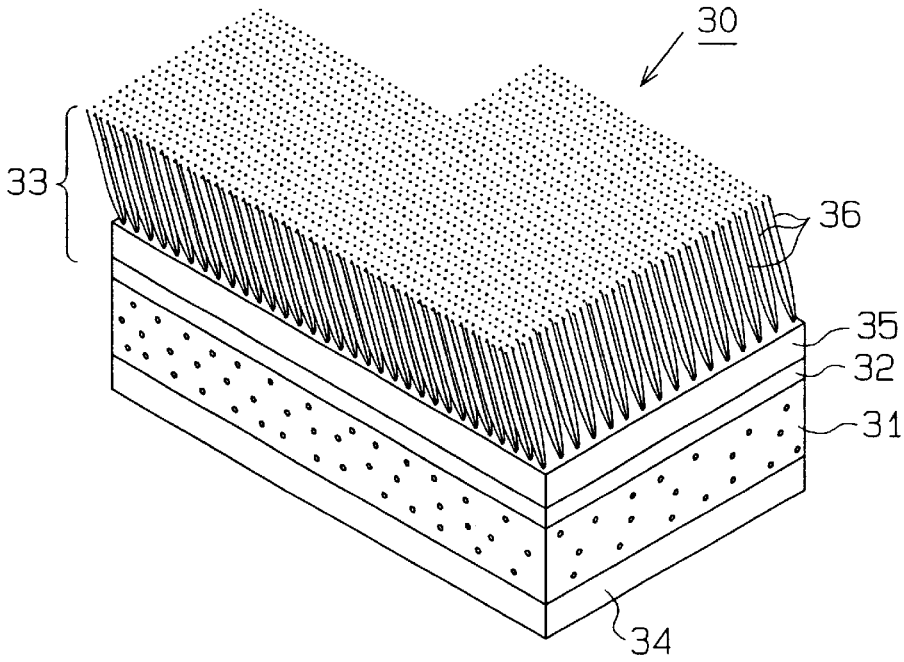
FIG. 1 is a perspective view illustrating a velour material according to a first embodiment.

As shown in FIG. 1, each piece of the cleaning material 30 has a supporting layer 31 made of cushioning material, a rubbing layer 33 attached to the supporting layer 31 with an adhesive film 32, and a sticking layer 34 formed on the back surface of the supporting layer 34. The rubbing layer 33 is formed with a velour material, which includes a ground fabric 35 made of synthetic resin and a plurality of pile yarns 36 raised on the ground fabric 35. The cleaning material 30 is formed by attaching the rubbing layer 33, the supporting layer 31, and the sticking layer 34, which are formed as sheets, to one another and die-cutting the obtained sheets.

As shown in FIGS. 5(*a*) and 5(*b*), a piece of the cleaning material 30 is attached to each projection 23*a* such that the pile yarns 36 on the rubbing layer 33 contact the corresponding end section of the photosensitive drum 11. The cleaning material 30 uses the pile yarns 36 to scrape the toner 15 off the surface of the photosensitive drum 11. The cleaning material 30 also collects the toner 15 flowing out through the space between the drum 11 and the housing 23, thereby preventing the toner 15 from escaping the housing 23.

In the cleaning material 30 shown in FIG. 1, the cushioning material forming the supporting layer 31 preferably has elasticity, high durability, and high heat resistance, and is capable of being bonded by adhesive. Such cushioning material may be resin foam such as polyurethane, polystyrene, and polypropylene. The cushioning material also may be synthetic rubber such as ethylene-propylene-diene copolymer rubber (EPDM) and chloroprene rubber, or natural rubber. Alternatively, the cushioning material may be thermoplastic elastomer such as olefin based elastomer and a styrene based elastomer.

The cushioning material preferably has 0.3 to 3 MPa in 25% compressive load according to the hardness testing method A of JIS K 6400. More preferably, the cushioning material has 0.5 to 2 MPa.

The hardness testing method A is carried out in the following manner.

First, a test specimen is placed flat on the base of a test machine. A pressurizing plate is placed on the test specimen and the load is increased to 5N. The thickness of the specimen at this time is measured. The measured thickness is set as an initial thickness. Then, the pressurizing plate is pressed down at a rate of 100 mm per minute until the specimen is depressed to 75% of the initial thickness. Immediately after this, the load is separated from the specimen. Immediately after the separation, the pressurizing plate is again pressed down at a rate of 100 mm per minute until the specimen is depressed to 25% of the initial thickness and is then stopped. When twenty seconds has past after the pressurizing plate is stopped, the load is measured. The measured load is defined as 25% compressive load.

If the compressive load is less than 0.3 MPa, the rubbing layer 33 cannot establish a sufficient contact with the photosensitive drum 11. If the compressive load is greater than 3 MPa, the resistance between the photosensitive drum 11 and the rubbing layer 33 will be excessive and hinder the rotation. In this embodiment, the supporting layer 31 is made of flame resistant polyurethane foam (Moltopren SM-55, a product of Inoac Corporation).

The adhesive film 32 and the sticking layer 34 are preferably formed with adhesive that is flexible after being hardened. Further, the adhesive film 32 and the sticking layer 34 are preferably heat resistant and flexible so that the film 32 and the layer 34 can be used in a curved state. As a tackifier having these characteristics, a rubber based or acrylic pressure-sensitive adhesive is used. The adhesive film 32 and the sticking layer 34 are formed by applying pressure-sensitive adhesive on the top surface and the back surface of the supporting layer 31. Alternatively, the film 32 and the layer 34 may be formed by applying pressure-sensitive adhesive on the surfaces of a stretch core material, and attaching the core material to the surfaces of the supporting layer 31. In this embodiment, the adhesive film 32 and the sticking layer 34 are formed with double-faced tapes that have acrylic adhesive. Specifically, the adhesive film 32 is made of double-faced tape #500, which is a product of Nitto Denko Corporation, and the sticking layer 34 is made of double-faced tape #5000NC, which is also a product of Nitto Denko Corporation.

Figure 2:
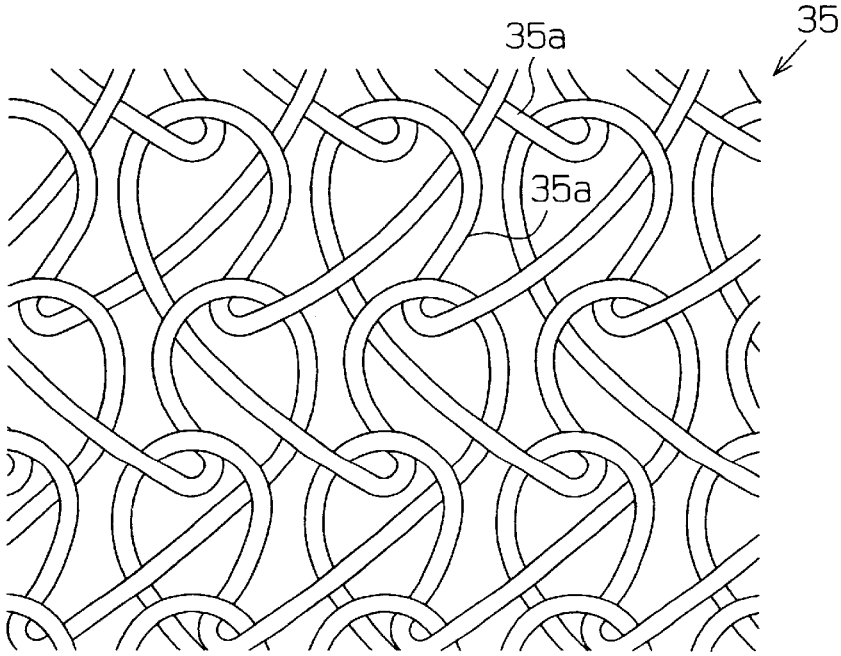
FIG. 2 is schematic view showing knit structure of a ground fabric.

As shown in FIG. 2, the ground fabric 35, which forms the rubbing layer 33, is formed with knit fabric. The knit fabric is formed by warp knitting, or by forming loops with ground yarns 35*a* and connecting the loops in the warp direction. Although not illustrated in FIG. 2, the pile yarns 36 are knit with the ground yarns 35*a* in a direction perpendicular to the direction in which the loops of the ground yarns 35*a* are connected. Then ground fabric 35 may be formed through weft knitting. However, a ground fabric with knit wefts is easily stretched, and when cut, the yarns are easily frayed. Therefore, when die-cut, a ground fabric formed with knit wefts is frayed or stretched, which hinders the fabric from having an accurate shape for cleaning material. Thus, warp knit fabric is used as the ground fabric 35.

Further, weft knitting is performed by forming loops one by one in each line with a single yarn across the width of the fabric. Therefore, loops are easily untied at the starting point of knitting. Contrarily, since warp knitting is performed by crossing warps one another, the yarns are not easily untied. Thus, warp knit fabric is less likely to be frayed than weft knit fabric.

A highly durable and flexible yarn is used as the ground yarn 35*a*. For example, a filament yarn or spun yarn is used as the ground yarn 35*a*. A fiber used for the ground yarn 35*a* preferably has a low coefficient of dynamic friction, a wear resistance, and a sufficient heat resistance, and is preferably capable of being bonded with adhesive. Such fiber may be formed of a synthetic fiber made of ultra-high-molecular-weight polyethylene, polypropylene, polyamide, aramid resin, polyester, nylon, acrylic resin, or polyethylene terephthalate (PET). The fiber may also be formed of semi-synthetic fiber such as rayon. Further, the fiber may be formed of natural fiber such as cotton. In this embodiment, a bulky spun yarn made of polyester fiber is used for the ground yarn 35*a*.

The pile yarns 36, which form the rubbing layer 33, are formed by twisting fibers that are highly durable and flexible, have a high wear resistance and a high sliding characteristic. Such fiber may be formed of a synthetic fiber made of ultra-high-molecular-weight polyethylene, polypropylene, polyamide, aramid resin, polyester, nylon, acrylic resin, polyethylene terephthalate (PET), or fluorocarbon resin. The fiber also may be formed of semi-synthetic fiber such as rayon. Among the listed fibers, the fiber made of fluorocarbon resin has a low coefficient of friction and is most preferable as a material for the pile yarns 36.

As the fluorocarbon resin, for example, polytetrafluoroethylene (PTFE), tetrafluoroethylene-perfluoroalkylvinylether copolymer (PFA), ethylene-tetrafluoroethylene copolymer (ETFE), or polyvinylidene fluoride (PVDF) is used. Usually, PTFE, which is most available, is used.

The size of the fibers forming the pile yarns 36 is preferably from 3 to 20 decitex, so that the rigidity of the fibers allows the fibers to be flexed, while preventing the fibers from lying. More preferably, the size of the fibers is from 5 to 10 decitex. In this embodiment, the pile yarns 36 are formed by twisting PTFE fibers of 7.3 decitex each. Each pile yarn 36 has 220 decitex/30 filaments.

The pile yarns 36 are knit with the ground yarns 35*a*, which forms the velour material forming the rubbing layer 33. In this state, the proximal portions of the pile yarns 36 are fastened by the ground yarns 35*a*, and at the distal ends of the pile yarns 36, the fibers are spread, which raises the pile yarns 36. Since the bulky spun yarns are used as the ground yarns 35*a*, the proximal portions of the pile yarns 36 are tightly fastened, which reliably holds the proximal portions of the pile yarns 36. A synthetic resin coating layer (not shown) is formed on the back surface of the ground fabric 35. The coating layer is formed with a coating agent made of emulsion. The ground yarns 35*a* forming the ground fabric 35 is impregnated with the coating agent. The coating layer prevents fraying and fixing the proximal portions of the pile yarns 36 with the ground fabric 35.

As described above, the velour material has the raised pile yarns 36 on the knit ground fabric 35. The velour material is formed by a double-raschel machine shown in FIG. 3. The double-raschel machine has a pair of facing knitting members 41 at the sides. The knitting members 41 are used for knitting fabric. A ground yarn 35*a* is supplied to each knitting member 41 from the above. The knitting members 41 each knit facing ground fabric 35. In this embodiment, a double-raschel machine of 24 gauge/2.54 cm (1 inch) is used. The ground fabric 35 is knit such that there are thirty-two ground yarns 35*a* in 2.54 cm in the course direction.

Figure 3:
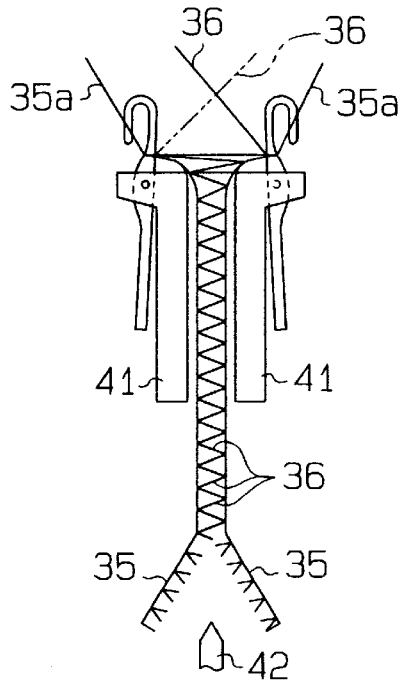
FIG. 3 is a schematic view showing a process for knitting ground fabric with a double raschel machine.

As shown by solid lines and two-dot chain line in FIG. 3, the pile yarns 36 are supplied to the knitting members 41 while reciprocating between the knitting members 41 and cross-linking the ground fabrics 35, each of which is knit by one of the knitting member 41. The two ground fabrics 35 cross-linked by the pile yarns 36 are discharged downward from the knitting members 41. The midpoints of the pile yarns 36 are cut by the cutter 42 to separate the ground fabrics 35 from each other, thereby forming two cut-pile velour material each having the ground fabric 35 and the pile yarns 36 of a predetermined lengths.

When forming the velour materials, the pile yarns 36 are preferably knit with the ground fabric 35 such that the number of the fibers forming the pile yarns 36 is from ten thousand to two hundred thousand in an area of 2.54 $cm^2$. If the number of the fibers is less than ten thousand, desired cleaning and particle flow blocking performance cannot be achieved. If the number is more than two hundred thousand, the resistance applied to the photosensitive drum 11 will be excessive and hinders the rotation.

The height of the pile yarns 36 from the surface of the ground fabric is preferably from 0.5 to 5 mm. If the height is less than 0.5 mm, the pile yarns 36 cannot cover the entire surface of the ground fabric 35, and spaces will be created among the pile yarns 36, which hinders the particle flow blocking performance for blocking the toner 15. Also, parts of the ground fabric 35 will be exposed through the spaces among the pile yarns 36 and contact the photosensitive drum 11, which will add to the resistance to the photosensitive drum 11. If the height of the pile yarns 36 is more than 5 mm, the area in which the pile yarns 36 contact the photosensitive drum 11 is enlarged. This increases the resistance. Also, contact between the pile yarns 36 and the drum 11 will flatten each pile yarn 36. This will hinder the cleaning and particle flow blocking performance and increase the cost.

The pile yarns 36 are inclined such that the distal portions are extended in the rotation direction of the photosensitive drum 11. The angle of the pile yarns 36 relative to the ground fabric 35 is preferably from 1 to 45 degrees, and more preferably, from 1 to 20 degrees. If the angle of the pile yarns 36 relative to the ground fabric 35 is less than 1 degree, substantially the entire pile yarns 36 contact the photosensitive drum 11. In this case, the pile yarns 36 cannot scrape the toner 15 off the drum 11 effectively. If the inclination angle is greater than 45 degrees, the spaces among the pile yarns 36 are too wide. In this case, the toner 15 trapped by the pile yarns 36 will escape.

The operation of the cleaning material 30 will now be described.

To manufacture the cleaning material 30, two velour materials are formed at the same time by double-raschel machine. Each velour material is used as the rubbing layer 33. The coating layer is formed on the back surface of each rubbing layer 33. Then, the supporting layer 31 is attached to the rubbing layer 33 with the adhesive film 32. Thereafter, the sticking layer 34 is formed on the back surface of the supporting layer 31. The supporting layer 31 is then die-cut in an L shape to obtain pieces of the cleaning material 30. The ground fabric 35 of the rubbing layer 33 is formed with the knit fabric obtained by warp knitting shown in FIG. 2. Since the ground yarns 35*a* are intertwined in a complicated manner, the yarns are not frayed when the cleaning material 30 is cut.

As shown in FIGS. 4, 5(*a*), and 5(*b*), the pieces of the cleaning material 30 are attached to the projections 23*a* of the housing 23 forming the cleaning member 18 such that the inner ends of the pieces of the cleaning material 30 are aligned with the inner ends of the space retaining caps 14*b* of the developing member 14. In this state, the pile yarns 36 slide on the photosensitive drum 11 and scrape of the toner 15 on sections of the drum 11 that contacts the space retaining cap 14*b*. Accordingly, the surface of the drum 11 is cleaned. The scraped toner 15 is trapped by the fibers forming the pile yarns 36 or by the knitted loops of the ground yarns 35*a* of the ground fabrics 35. Then, the toner 15 is collected in the rubbing layer 33.

The toner 15 scraped by the cleaning blade 21 moves sideways toward the exterior of the housing 23. At this time, in addition to the toner collecting function, the pile yarns 36 and the supporting layers 31 act as walls against the flow of the toner 15 and block the flow of the toner 15.

As described above, the cleaning material 30 clean the surface of the photosensitive drum 11 and prevent the toner 15 from flowing outward. Therefore, the toner 15 is prevented from entering the space between the photosensitive drum 11 and the retaining caps 14*b* located at the ends of the developing roller 14*a*, which substantially maintains the distance between the photosensitive drum 11 and the developing roller 14*a*. That is, the space 14*c* is maintained substantially constant.

The advantages of the first embodiment are as follows.

The ground fabric 35 of the rubbing layer 33 forming the cleaning material 30 are formed through warp knitting. The knit fabric is formed by making loops of the ground yarns 35*a* and connecting the loops in the warp direction. Since the ground yarns 35*a* are intertwined in a complicated manner, the yarns are prevented from being frayed when the fabric is cut. The pile yarns 36 are knit with the ground yarns 35*a*. The proximal portions of the pile yarns 36 are tightly fastened to the ground yarns 35*a*, which prevents the pile yarns 36 from falling off the ground fabric 35.

Warp-knit fabric is basically unlikely to be expanded or contracted. Therefore, the knitted loops of the ground fabric 35 are not easily expanded, and the ground yarns 35*a* are not easily untied. The pile yarns 36 are thus reliably prevented from falling off.

Two velour materials used for the rubbing layers 33 are formed at the same time by knitting the ground yarns 35*a* and the pile yarns 36 and separating the knit materials in the middle by the double raschel machine. This permits the velour materials to be easily and rapidly manufactured.

The synthetic resin forming the supporting layers 31 of the cleaning material 30 has 0.3 to 3 MPa in 25% compressive load when measured by the hardness testing method A of JIS K 6400. Therefore, the pile yarns 36 have a sufficient contact with the photosensitive drum 11 without hindering the rotation of the drum 11.

The pile yarns 36 of the cleaning material 30 are inclined relative to the ground fabric 35 by 1 to 45 degrees, so that the distal portion of the pile yarns 36 extend in the rotation direction of the photosensitive drum 11. Therefore, pile yarns 36 contact the photosensitive drum 11 in an effective manner to scrape off the toner 15 from the drum 11. Also, the scraped toner 15 is efficiently collected by the pile yarns 36.

The emulsion coating is formed on the back surface of the rubbing layer 33. This effectively prevents the knitted loops of the ground fabric 35 from being expanded. The proximal portions of the pile yarns 36 are therefore securely held by the knitted loops.

The pile yarns 36 are formed with fluorocarbon resin synthetic fibers. This reduces the resistance applied to the photosensitive drum 11.

The first embodiment may be modified as follows.

The cleaning material 30 may be used for cleaning and blocking microscopic particles other than the toner 15. For example, the cleaning material 30 may be used for cleaning and blocking paper powder or dust.

As long as the cleaning material 30 includes the rubbing layer 33, at least one of the supporting layer 31, the adhesive film 32, the coating layer, and the sticking layer 34 may be omitted. For example, the adhesive film 32 may be omitted and the rubbing layer 33 may be attached to the surface of the supporting layer with emulsion coating in between. Also, the coating layer may be omitted, and the proximal portions of the pile yarns 36 may be coupled to the ground fabric 35 by the adhesive film 32. Alternatively, the supporting layer 31 may be omitted, and the cleaning material 30 may be formed only with the rubbing layer 33 and the coating layer.

The cleaning material 30 may be located ahead of or behind the cleaning member 18 in the rotation direction of the photosensitive drum 11. In this case, the cleaning material 30 performs only the cleaning function. In this case, as long as the cleaning material 30 includes the rubbing layer 33, at least one of the supporting layer 31, the adhesive film 32, the coating layer, and the sticking layer 34 may be omitted.

A sealing material similar to the cleaning material 30 may be formed. The sealing material is used for blocking the flow of microscopic particles. The sealing material has a supporting layer made of cushioning material, a rubbing layer attached to the supporting layer with an adhesive film, a coating layer formed on the back surface of the rubbing layer, and a sticking layer formed on the back surface of the supporting layer. The sealing material is formed as a flat elongated rectangular and is located between the developing roller 14*a* and the housing 14*d*. The sealing material contacts the ends of the developing roller 14*a* and is located inward of the space retaining caps 14*b*. The sealing material is coupled to a supporting body, which is the housing 14*d*, such that the sealing material contacts substantially half of the circumference of the developing roller 14*a*. When the toner 15 is applied to the developing roller 14*a*, the toner 15 moves toward the surface of the space retaining caps 14*b* through the space between the roller 14*a* and the housing 14*d*. The sealing material blocks the flow of the toner 15 by trapping the toner in pile yarns in the rubbing layer, thereby preventing the toner 15 from reaching the surface of the caps 14*b*.

The sealing material, which has a ground fabric of the rubbing layer formed with knit fabric obtained through warp knitting, prevents yarns from fraying when cut and effectively blocks flow of microscopic particles. The sealing material may be attached to the developing roller 14*a*. Further, as long as the sealing material has the rubbing layer, at least one of the supporting layer, the adhesive film, the coating layer, and the sticking layer may be omitted.

The location of a cleaning material for cleaning and blocking flow of particles, a sealing material only for blocking flow of particles, or a cleaning material only for cleaning is not limited to the developing member 14 or the cleaning member 18. The materials may be located at any part of the apparatus where microscopic particles exist. For example, any of the materials may be located on the transfer belt of the transferring member 16 or on the conveyer belt for conveying the recording paper sheet 17.

Alternatively, the material may be used in apparatus other than the electrophotography apparatus. For example, the material may be used for cleaning a powder feeding roller of a packaging machine for packaging powdered or granulated medicine. Further, the materials may be used for cleaning a conveyer for conveying articles such as films in a factory. Also, the material may be used for cleaning a lens of an information reader and a sheet slot of an information reader, such as the cash card slot of a cash dispenser at banks, the phonecard slot of a pay phone, and a bill slot of a vending machine. The material may be used for sealing spaces in pieces of furniture such as double sliding sashes, and a chest, or the windows of cars.

The knit fabric forming the ground fabric 35 need not be knit with a double-raschel machine, but may be knit with double tricot machine.

The pile yarns 36 may be electrically conductive. To make the pile yarns 36 conductive, for example, metal such as nickel, a metal compound such as zinc oxide and tin oxide, and conductive material such as carbon particles may be incorporated in the raw material of the yarns. Also, the surfaces of the fibers forming the pile yarns 36 may be coated with working fluid containing conductive material. In this case, static electricity of the toner 15 is removed, which facilitates removal of toner 15 from the surface of the photosensitive drum 11 when the toner 15 is attached to the surface by static electricity.

Not only the pile yarns, but also at least one of the supporting layer 31, the adhesive film 32, the coating layer, and the sticking layer 34 may be formed to have conductivity by incorporating any of the listed conductive materials. In this case, static electricity is more effectively removed. Also, if the entire cleaning material or the entire sealing material including the pile yarns 36 are conductive, the cleaning material or the sealing material can be charged.

A second embodiment of the present invention will now be described. The differences from the first embodiment will mainly be discussed below.

Figure 8:
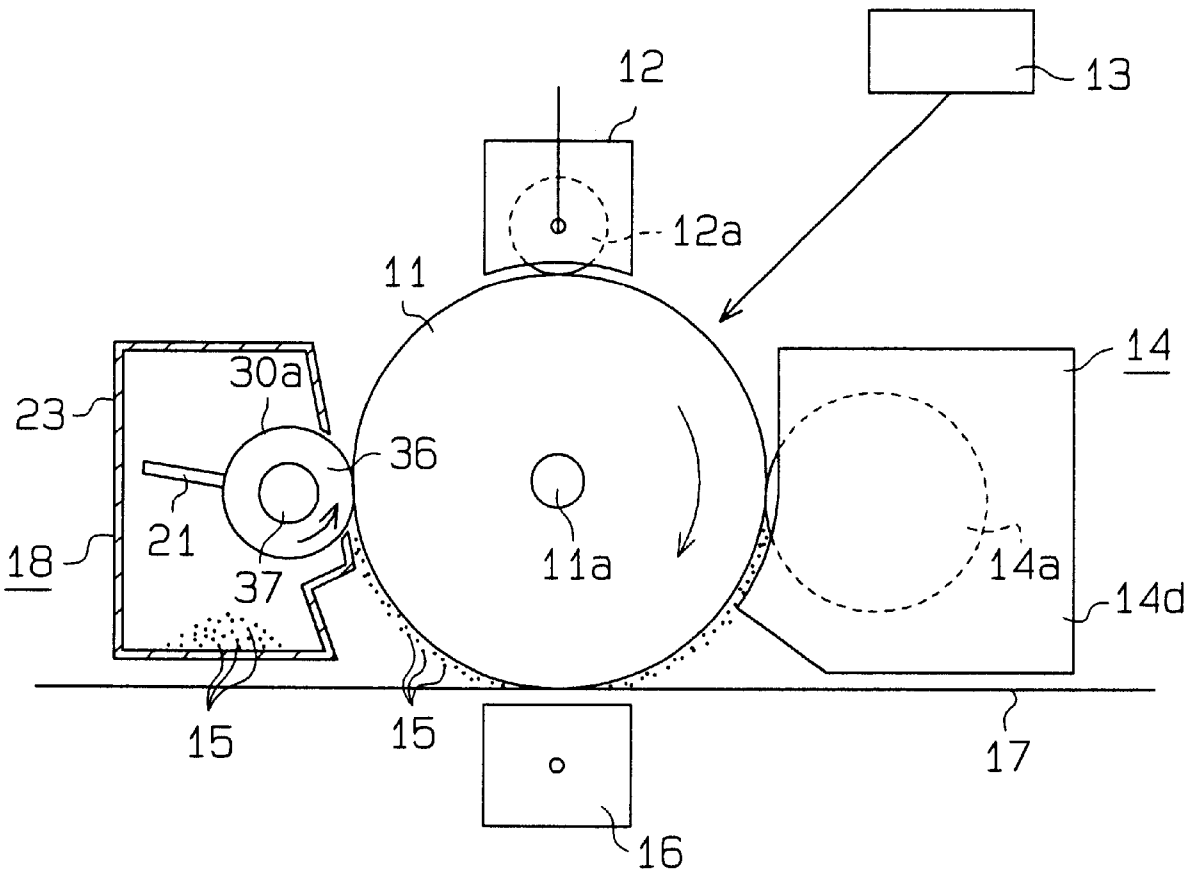
FIG. 8 is a schematic view showing an electrophotography apparatus according to the second embodiment.

FIG. 8 is a schematic view showing the electrophotography apparatus according to the second embodiment. A cleaning material 30*a* is accommodated in a housing 23 of a cleaning member 18 in a rolled state. The cleaning material 30*a* is rotatably supported such that the surface of the cleaning material 30*a* contacts the surface of a photosensitive drum 11. A cleaning blade 21 is located adjacent to the cleaning material 30*a* such that the distal end of the cleaning blade 21 contacts the circumference of the cleaning material 30*a*. The toner 15 remaining on the photosensitive drum 11 is scraped off the drum 11 by pile yarns 36 of the cleaning material 30*a*. The toner 15 is then scraped off the cleaning material 30*a* by the cleaning blade 21 and collected in the housing 23.

Figure 6:
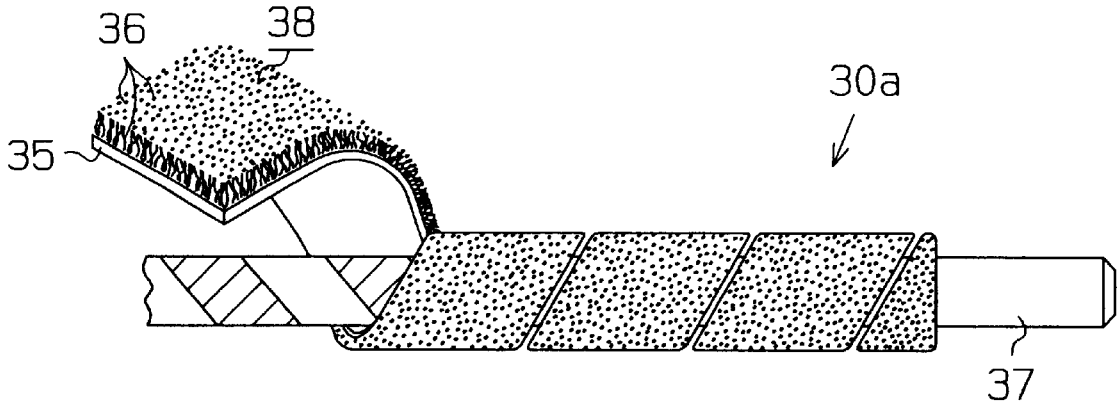
FIG. 6 is a front view showing a process for manufacturing cleaning material according to a second embodiment.

As shown in FIG. 6, the cleaning material 30*a* includes a supporting shaft 37 and a pile fabric 38 attached onto the surface of the shaft 37. The supporting shaft 37 has a circular cross-section and is made of metal such as aluminum and stainless steel. Adhesive is applied to the surface of the supporting shaft 37. Then, the pile fabric 38 is helically attached to the surface of the shaft to form the cleaning material 30*a*.

Figure 7:
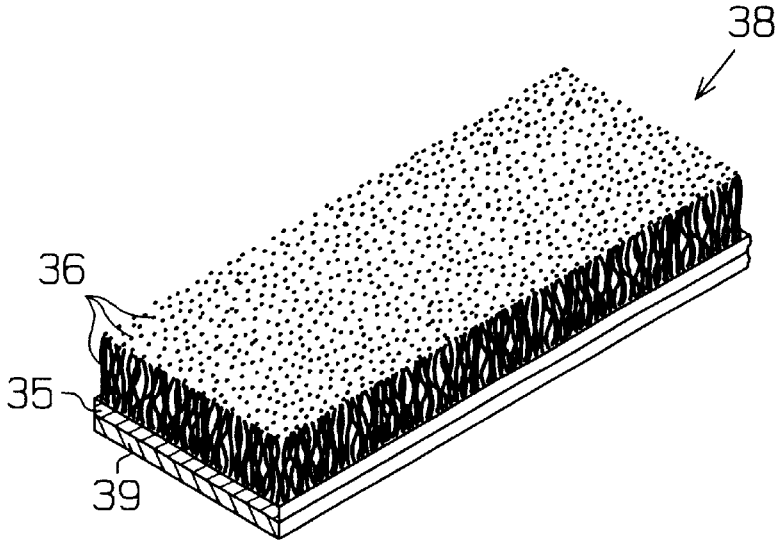
FIG. 7 is a perspective view illustrating pile fabric according to the second embodiment.

As shown in FIG. 7, the pile fabric 38 is formed with a velour material, which includes a ground fabric 35 and pile yarns 36. The ground fabric 35 is made by warp knitting ground yarns. The pile yarns 36 are knit with the ground yarns 35*a* by twisting and raised. As the ground yarns used in the ground fabric 35, highly durable and flexible filament yarns or spun yarns are used. These yarns include synthetic fibers, semi-synthetic fiber, or natural fiber, which have a low coefficient of dynamic friction, a wear resistance, and a sufficient heat resistance and is capable of being bonded with adhesive. A synthetic resin coating layer 39 is formed on the back surface of the ground fabric 35. The coating layer 39 is formed with a coating agent made of emulsion. The ground yarns 35*a* forming the ground fabric 35 is impregnated with the coating agent. The coating layer 39 prevents fraying and fixes the proximal portions of the pile yarns 36 to the ground fabric 35.

The pile yarns 36 are formed by twisting fibers that are highly durable and flexible, have a high wear resistance and a high sliding property. Particularly, synthetic fiber made of fluorocarbon resin has a low coefficient of friction and is most preferable as a material for the pile yarns 36. As the fluorocarbon resin, tetrafluoroethylene-hexafluoropropylene copolymer (FEP) may be used in addition to the ones listed above. The size of the fibers forming the pile yarns 36 is preferably from 3 to 20 decitex, so that the rigidity of the fibers allows the fibers to be flexed, while preventing the fibers from lying. More preferably, the size of the fibers is from 5 to 10 decitex. In this embodiment, the pile yarns 36 are formed by twisting FEP fibers of 8.8 decitex each. Each pile yarn 36 has 440 decitex/50 filaments.

The pile fabric 38 is formed with a tricot machine. The tricot machine forms the pile fabric 38 through warp knitting. That is, the tricot machine forms loops with ground yarns and the pile yarns 36, while knitting the ground yarns and the pile yarns 36 perpendicularly, and connects the loops in the warp direction. In this embodiment, a tricot machine of 40 gauge/2.54 cm (1 inch) is used. The ground fabric 35 is knit such that there are 40 ground yarns in 2.54 cm in the course direction.

Figure 9:
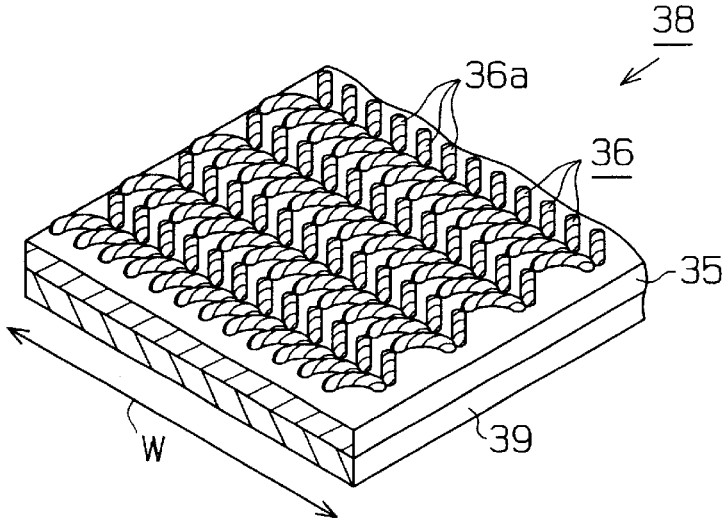
FIG. 9 is a perspective view illustrating pile fabric before being cut open.

As shown in FIG. 9, on the surface of the pile fabric 38, which is knit by the tricot machine, the pile yarns 36 are knit with form loops 36*a*. The loops 36*a* are arranged in a high density on lines inclined relative to the wale direction (shown by arrow W). The pile yarns 36 are knit to form a plurality of courses. The inclination direction of the loops 36*a* is reversed at every course. If the pile fabric 38 is formed through weft knitting, the loops of the pile yarns 36 cannot be arranged in a high density on the surface of the ground fabric 35, and the pile yarns cannot be knit in a high density on the ground fabric 35.

Figure 10:
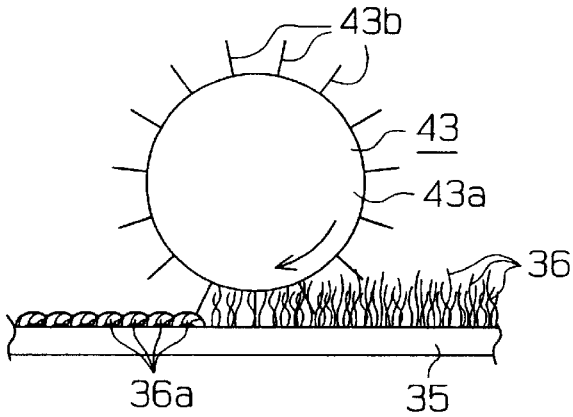
FIG. 10 is a schematic view showing pile fabric before being cut open.

After being knit with the tricot machine, the pile fabric 38 is cut open by a machine shown in FIG. 10. Specifically, the loops 36*a* of the pile yarns 36 are cut. That is, the machine of FIG. 10 has a card clothing roller 43. The roller 43 includes a substantially cylindrical supporting body 43*a* and needles 43*b* protruding from the circumference of the supporting body 43*a*. The card clothing roller 43 is rotated such that the distal ends of the needles 43*b* contact the loops 36*a* of the pile yarns 36. The needles 43*b* scratches the loops 36*a* to cut the pile yarns 36 at the loops 36*a*.

After being scratched by the needles 43*b*, the pile yarns 36 are cut open at the loops 36*a*. Since the proximal portions are fastened by the ground yarns, the pile yarns 36 are raised with the upper ends spaced from one another. The raised pile yarns 36 are not standing straight from the ground fabric 35 but are entangled to one another. The raised pile yarns 36 have an increased density and an improved shock absorbing property. The pile yarns 36 therefore gently contacts the photosensitive drum 11 and do not scratch the drum 11. Since the pile yarns 36 are entangled, the inclination direction of each pile yarn 36 need not be considered, and the process for inclining the yarns 36 is omitted.

Figure 11:
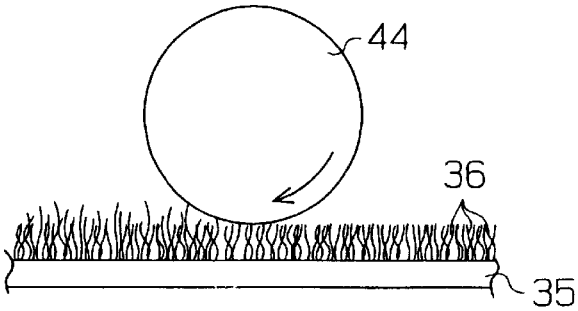
FIG. 11 is a schematic view showing a process for shirring pile fabric.

The pile fabric 38 is subjected to shearing by using machine shown in FIG. 11. The fabric 38 is trimmed to have a constant height from the ground fabric 35. The machine used for shearing includes a substantially cylindrical rotary blade 44. The rotary blade 44 is rotatably located at a predetermined height from the surface of the ground fabric 35. The rotary blade 44 contacts and cuts the upper end portions of the pile yarns 36 to trim the pile yarns 36 to the predetermined height. After the pile yarns 36 are trimmed to the predetermined height, the ground fabric 35 of the pile fabric 38 is cut to form a belt, which, in turn, attached to the supporting shaft 37.

After shearing, the height of the pile yarns 36 from the surface of the ground fabric 35 is preferably from 0.5 to 5 mm. If the height is less than 0.5 mm, the pile yarns 36 cannot cover the entire surface of the ground fabric 35, and spaces will be created among the pile yarns 36, which causes part of the ground fabric 35 to contact the surface of the photosensitive drum 11 and thus increases the contact resistance. If the height of the pile yarns 36 is more than 5 mm, the area in which the pile yarns 36 contact the photosensitive drum 11 is enlarged. This increases the resistance. Also, contact between the pile yarns 36 and the drum 11 will flatten each pile yarn 36. This will hinder the cleaning and particle flow blocking performance and increase the cost.

The operation of the cleaning material 30*a* will now be described.

When manufacturing the cleaning material 30*a*, the pile fabric 38 shown in FIG. 9 is formed by using a tricot machine. The coating layer 39 is formed on the back surface of the pile fabric 38. Then, the pile yarns 36 are cut open by using the machine shown in FIG. 10 and raised on the ground fabric 35. Thereafter, the pile yarns 36 are sheared by using the machine shown in FIG. 11. As a result, the pile yarns 36 are trimmed at a predetermined height, which is in range from 0.5 to 5 mm.

After bearing sheared, the ground fabric 35 is cut to form the belt shaped fabric 38. The ground fabric 35 is formed with the knit fabric obtained by warp knitting. Since the ground yarns are intertwined in a complicated manner, the yarns are not frayed when the fabric 35 is cut. Since the pile yarns 36 are intertwined in a complicated manner and the inclination directions of the pile yarns 36 need not be considered, the pile yarns 36 have the same inclination state regardless whether the ground fabric 35 is cut in the wale direction or in a direction perpendicular to the wale direction. Accordingly, a uniform pile is obtained. After being cut open and sheared, the belt shaped pile fabric 38 is helically wound about and adhered to the circumference of the support shaft 37. The cleaning material 30*a* is thus produced.

As shown in FIG. 8, the cleaning material 30*a* is rotatably supported in the housing 23 of the cleaning member 18 such that the pile yarns 36 on the surface slide on the photosensitive drum 11. The cleaning material 30*a* scrapes off the toner 15 on the surface of the photosensitive drum 11 with the pile yarns 36, thereby cleaning the surface of the photosensitive drum 11. The scraped toner 15 is trapped in the intertwined pile yarns 36. Also, the distal end of the cleaning blade 21 slides on the surface of the cleaning material 30*a* to drop the toner 15 from the pile yarns 36 to the bottom of the housing 23. The pile yarns 36 are intertwined in a complicated manner and are densely arranged, which gives the pile yarns 36 an improved shock absorbing property. Therefore, when cleaning the surface of the photosensitive drum 11, the pile yarns 36 do not damage the drum 11.

The advantages of the second embodiment are as follows.

The ground fabric 35 of the pile fabric 38 forming the cleaning material 30 is formed through warp knitting. The fabric is formed by making loops of the ground yarns and connecting the loops in the warp direction. Since the ground yarns are intertwined in a complicated manner, the yarns are prevented from being frayed when the fabric is cut. The pile yarns 36 are knit with the ground yarns. The proximal portions of the pile yarns 36 are tightly fastened to the ground yarns, which prevents the pile yarns 36 from falling off the ground fabric 35.

The pile yarns 36 are knit with the ground fabric 35 and looped with the tricot machine. Then, the pile yarns 36 are cut open and raised. Compared to a double-raschel machine, switching of knitting processes, such as changing of yarns, is easy in the tricot machine. Therefore, the tricot machine is suitable for a small-volume manufacture and reduces manufacturing time. After being cut open, the pile yarns 36 do not stand straight from the ground fabric 35 but are intertwined with one another. Thus, the inclination direction of the pile yarns 36 need not be considered. Therefore, the inclination state of the pile yarns 36 is constant regardless whether the ground fabric 35 is cut along the wale direction or along the course direction, and the pile state of the pile yarns 36 are constant without inclining the yarns 36.

The pile yarns 36 are cut open by causing the card clothing roller 43 to slide on the pile yarns 36 so that the needles 43*b* cut the loops 36*a* by scratching. The pile yarns 36 are therefore easily and quickly cut open.

When the cleaning material 30*a* is formed, the velour material, which is the pile fabric 38, is sheared before being wound about the supporting shaft 37. When forming a prior art roll cleaning material, a velour material is first wound about and adhered to a supporting shaft before being sheared. In contrast, the velour material, which is the pile fabric 38, is sheared while being held flat in this embodiment. Therefore, the height of the pile yarns 36 is accurately trimmed, and the shearing is facilitated. Thus, the roll cleaning material of this embodiment has a smaller diameter than that of the prior art roll cleaning material.

The emulsion coating layer 39 is formed on the back surface of the ground fabric 35. The coating layer 39 effectively prevents the knitted loops of the ground fabric 35 from being expanded. Accordingly, the proximal portions of the pile yarns 36 are reliably fastened.

The pile yarns 36 are formed with fluorocarbon fibers. This reduces the resistance applied to the photosensitive drum 11.

The second embodiment may be modified as follows.

The pile yarns 36 may be electrically conductive. To make the pile yarns 36 conductive, for example, metal such as nickel, a metal compound such as zinc oxide and tin oxide, and conductive material such as carbon particles may be incorporated in the raw material of the yarns. Also, the surfaces of the fibers forming the pile yarns 36 may be coated with working fluid containing conductive material. In this case, static electricity of the toner 15 is removed, which facilitates removal of toner 15 from the surface of the photosensitive drum 11 when the toner 15 is attached to the surface by static electricity.

If the pile yarns 36 are given conductivity, the cleaning material 30*a* may be applied to members other than the cleaning member 18 of the second embodiment. For example, the cleaning material 30*a* may be used in both or one of a charging brush 12*a* of the charging member 12 and the developing roller 14*a* of the developing member 14.

Figure 12:
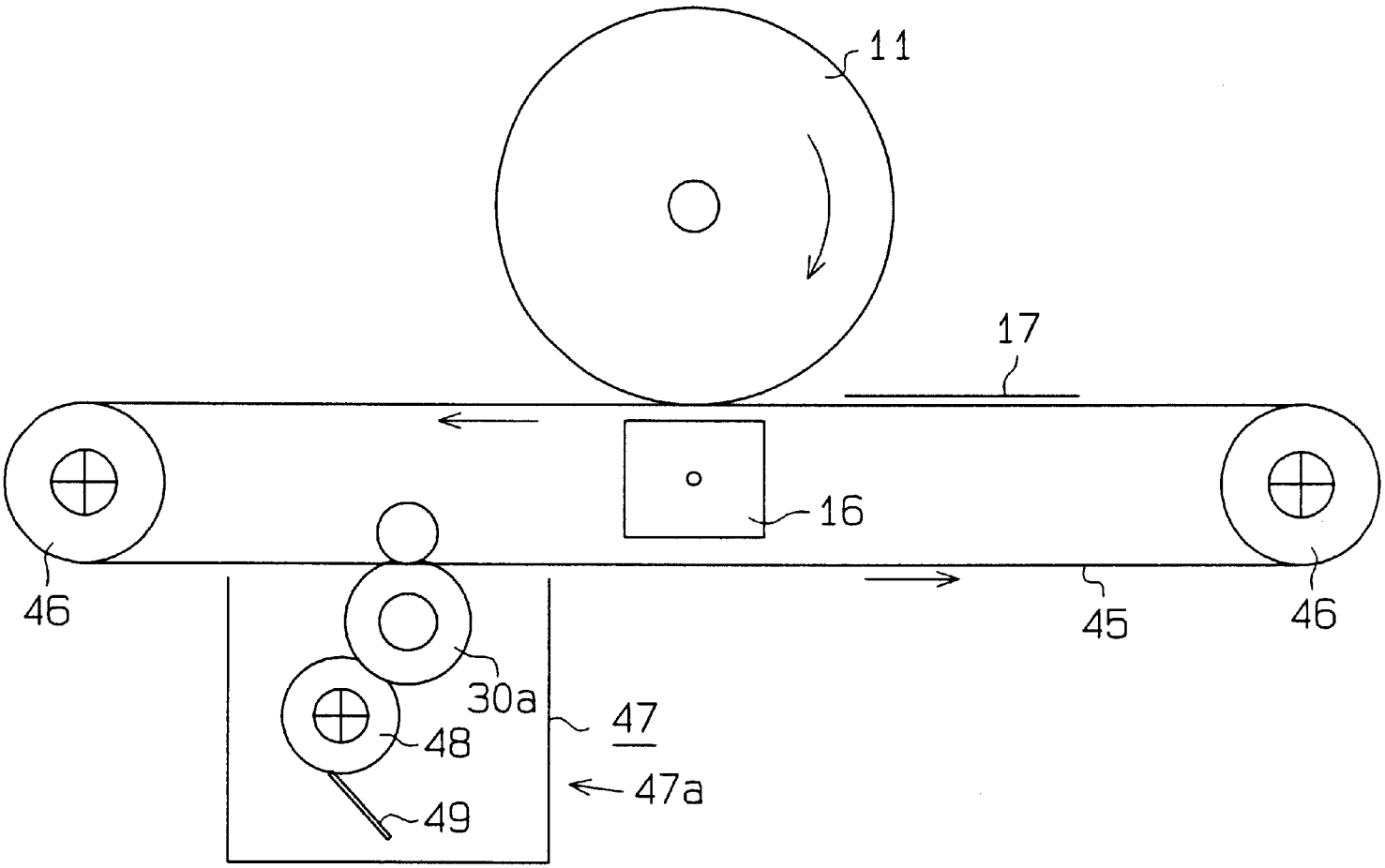
FIG. 12 is a schematic view showing an electrophotography apparatus according to another embodiment.

In the embodiment of FIG. 8, the cleaning material 30*a* is arranged to contact the photosensitive drum 11. However, as shown in FIG. 12, the cleaning material 30*a* may be used in another type of image forming apparatus. The apparatus of FIG. 12 has a transfer belt 45 for moving the recording sheet 17 to the transferring member 16. The cleaning member 30*a* is arranged to contact the transfer belt 45.

The transfer belt 45 is arranged between a pair of rollers 46. The transferring member 16 is located in the space inward of the transfer belt 45. The apparatus of FIG. 12 has a cleaning member 47. The cleaning member 47 has a housing 47*a*, which is located below the transfer belt 45. The cleaning material 30*a* is rotatably supported in the housing 47*a* such that the cleaning material 30*a* contacts the surface of the transfer belt 45. A removing roller 48 is also rotatably supported in the housing 47*a* to be pressed against the cleaning material 30*a*. Below the removing roller 48 is arranged a removing blade 49 such that the distal end of the blade 49 contacts the circumference of the removing roller 48.

When the cleaning material 30*a* contacts the transfer belt 45, static of the paper powder, toner, and dust on the belt 45 is eliminated. At the same time, the paper powder, the toner and the dust are scraped off the belt 45 by the cleaning material 30*a*. Thereafter, the paper powder, the toner, and the dust are removed from the surface of the cleaning material 30*a* and collected in the housing 47*a* by the removing roller 48 and the removing blade 49. In this manner, the cleaning material 30*a* is used for cleaning the transfer belt 45 in the apparatus shown in FIG. 12. In this case, the conductive pile yarns 36 of the cleaning material 30*a* effectively remove paper powder, toner, and dust from the transfer belt 45.

When giving conductivity to the pile yarns 36, the pile yarns 36 may be formed by combining conductive fibers and insulating chemical fibers. The insulating chemical fibers include regenerated fibers such as rayon fibers and cupra fibers, and synthetic fibers such as nylon, acrylic, polypropylene, and polyester. If the pile yarns 36 are formed by combining conductive fibers and insulating fibers, the amount of conductive fibers, which are costly, is reduced. Accordingly, the manufacturing cost is reduced.

Not only the pile yarns 36, but also at least one of the supporting layer 35 and the coating layer 39 may be formed to have conductivity by incorporating any of the listed conductive materials. In this case, static electricity is more effectively removed. Also, if the entire cleaning material including the pile yarns 36 are conductive, the cleaning material can be charged.

The pile fabric 38 of the cleaning material 30*a* need not include the coating layer 39 and may be formed only with the ground fabric 35 and the pile yarns 36.

The knit fabric forming the ground fabric 35 need not be knit with a tricot machine, but may be knit with raschel machine.

In the second embodiment, the loop 36*a* of the pile yarns 36 are cut open by the needles 43*b* of the card clothing roller 43. However, the loops 36*a* may be cut open by, for example, inserting a cutter.

In the second embodiment, the cleaning material 30*a* is formed by winding a pile fabric sheet about the supporting shaft 37. The pile fabric sheet is formed by a tricot machine or a raschel machine. However, the velour material formed by the double tricot machine or a double raschel machine described in the first embodiment may be used as the pile fabric sheet of the second embodiment. In this case, the fabric sheet is cut to have a shape of a belt and is then wound about the supporting shaft 37 to form the roll cleaning material. In this case, the ground fabric forming the pile fabric sheet is effectively prevented from being frayed. Also, after the pile fabric sheet or the roll cleaning material is formed, the pile yarns may be inclined in a given direction. This gives a rotation direction to the cleaning material.

In the second embodiment, the cleaning material 30*a* is formed by winding a pile fabric sheet about the supporting shaft 37. The pile fabric sheet is formed by a tricot machine or a raschel machine. However, the pile fabric 38 may be replaced with a velour material. In this case, the velour material is cut into a predetermined shape. Then, a rubbing layer is formed in the velour material. Subsequently, a supporting layer, an adhesive film, a coating layer, and a sticking layer are attached to the back surface of the velour material. Accordingly, a cleaning material that has a cleaning function and particle blocking function is produced. Further, as long as the sealing material has the rubbing layer, at least one of the supporting layer, the adhesive film, the coating layer, and the sticking layer may be omitted. The cleaning materials may be located ahead of or behind the cleaning member 18 in the rotation direction of the photosensitive drum 11. In this case, the cleaning materials perform only the cleaning function.

The pile fabric 38, which is formed by a tricot machine or a raschel machine, may be used as a rubbing layer in a sealing material for preventing microscopic particles from leaking. In this case, like the cleaning material described in the fist embodiment, the cleaning material includes the rubbing layer, a supporting layer made of cushioning material, a rubbing layer attached to the supporting layer with an adhesive film, a coating layer formed on the back surface of the rubbing layer, and a sticking layer formed on the back surface of the supporting layer. The sealing material is formed as a flat elongated rectangular and is located between the developing roller 14*a* and the housing 14*d* of the first embodiment. The sealing material contacts the ends of the developing roller 14*a* and is located inward of the space retaining caps 14*b*. When the toner 15 is applied to the developing roller 14*a*, the toner 15 moves toward the surface of the space retaining caps 14*b* through the space between the roller 14*a* and the housing 14*d*. The sealing material blocks the flow of the toner 15 by trapping the toner in pile yarns in the rubbing layer, thereby preventing the toner 15 from reaching the surface of the caps 14*b*.

In this manner, the sealing material, which has a ground fabric of the rubbing layer formed with knit fabric obtained through warp knitting, prevents yarns from being frayed when cut and effectively blocks flow of microscopic particles. The sealing material may be attached to the developing roller 14*a*. Further, as long as the sealing material has the rubbing layer, at least one of the supporting layer, the adhesive film, the coating layer, and the sticking layer may be omitted.

The pile fabric 38, which is knit by a tricot machine or a raschel machine, may be subjected to a pile yarn inclining process as in the first embodiment. In this case also, the pile yarns 36 effectively contact the photosensitive drum 11 and reliably scrape off the toner 15. The scraped off toner 15 is effectively collected in the pile yarns 36.

The cleaning material for cleaning and blocking flow of particles, the sealing material only for blocking flow of particles, and the cleaning material only for cleaning are not necessarily located on the developing member 14 or on the cleaning member 18. The materials may be located at any part of the apparatus where microscopic particles exist. For example, the materials may be located on the transfer belt of the transferring member 16 or on the conveyer belt for conveying the recording paper sheet 17.

Alternatively, the materials may be used in apparatuses other than the electrophotography apparatus. For example, the cleaning materials may be used on a powder feeding roller of a packaging machine for packaging powdered or granulated medicine. Further, the cleaning materials may be used for cleaning a conveyer for conveying articles such as films in a factory. Also, the materials may be used for cleaning a lens of an information reader and a sheet slot of an information reader, such as the cash card slot of a cash dispenser at banks, the phonecard slot of a pay phone, and a bill slot of a vending machine. The material may be used for sealing spaces in pieces of furniture such as double sliding sashes, and a chest, or the windows of cars.

Therefore, the present examples and embodiments are to be considered as illustrative and not restrictive and the invention is not to be limited to the details given herein, but may be modified within the scope and equivalence of the appended claims.

What is claimed is:

1. A cleaning material attached to a supporting body facing a moving body that contacts microscopic particles, comprising:

a ground fabric formed with a knit fabric, wherein the knit fabric is obtained through warp knitting ground yarns; and pile yarns raised on the ground fabric, wherein the pile yarns slide on the moving body to scrape off the microscopic particles on the moving body, thereby cleaning the surface of the moving body.

2. A cleaning material attached to a supporting body facing a moving body that contacts microscopic particles, comprising:

a ground fabric formed with a knit fabric, wherein the knit fabric is obtained through warp knitting ground yarns; and pile yarns raised on the ground fabric, wherein the pile yarns slide on the moving body to scrape off the microscopic particles on the moving body, thereby cleaning the surface of the moving body, and wherein the pile yarns block flow of microscopic particles through the space between the moving body and the supporting body and collect the particles.

3. The cleaning material according to claim 1, wherein the ground fabric is knit in two sheets facing each other, wherein, after the pile yarns are knit with the two sheets to cross-link the sheets, the midsections of the pile yarns are cut between the sheets to form two sheets of the ground fabric, and wherein the pile yarns are raised on each sheet of the ground fabric.

4. The cleaning material according to claim 1, wherein a supporting layer made of cushioning material is located on the back surface of the ground fabric.

5. The cleaning material according to claim 1, wherein the angle of the pile yarns relative to the ground fabric is 1 to 45 degrees.

6. The cleaning material according to claim 1, wherein a coating layer is located on the back surface of the ground fabric.

7. The cleaning material according to claim 1, wherein the pile yarns are formed of fluorocarbon resin fibers.

8. The cleaning material according to claim 1, wherein the supporting body comprises a supporting shaft, and wherein the ground fabric is helically wound about the supporting shaft such that the pile yarns are exposed.

9. The cleaning material according to claim 1, wherein the height of the pile yarns from the surface of the ground fabric is 0.5 to 5 mm.

10. The cleaning material according to claim 1, wherein the number of the fibers forming the pile yarns is ten thousand to two hundred thousand in an area of 2.54 $cm^2$.

11. The cleaning material according to claim 1, wherein the size of the fibers forming the pile yarns is 3 to 20 decitex.

12. The cleaning material according to claim 1, wherein the ground fabric is formed of spun yarns.

13. The cleaning material according to claim 1, wherein the pile yarns are formed of conductive fibers.

14. The cleaning material according to claim 1, wherein the pile yarns are knit with the ground fabric to form loops, and wherein the loops of the pile yarns are cut open so that the pile yarns are raised on the ground fabric.

15. The cleaning material according to claim 14, wherein the supporting body comprises a supporting shaft, and wherein the ground fabric is helically wound about the supporting shaft such that the pile yarns are exposed.

16. The cleaning material according to claim 14, wherein the angle of the pile yarns relative to the ground fabric is 1 to 45 degrees.

17. A method for manufacturing a cleaning material attached to a supporting body facing a moving body that contacts microscopic particles, comprising:

forming a ground fabric with a knit fabric, wherein the knit fabric is obtained through warp knitting ground yarns; and raising the pile yarns on the ground fabric by knitting the pile yarns with the ground fabric to form loops, and then cutting open the loops of the pile yarns.

18. The method according to claim 17, wherein the loops of the pile yarns are cut open by scratching to raise the pile yarns.

19. The method according to claim 18, wherein, after being raised, the pile yarns are sheared such that the height of the pile yarns from the surface of the ground fabric is 0.5 to 5 mm.

20. The method according to claim 17, wherein the pile yarns are knit with the ground fabric by using a tricot machine or a raschel machine.

21. The method according to claim 17, wherein the pile yarns are knit with the ground fabric by using a double tricot machine or a double raschel machine.

22. A sealing material attached to a moving body that contacts microscopic particles or to a supporting body facing the moving body, wherein the sealing material blocks flow of microscopic particles through the space between the moving body and the supporting body, the sealing material comprising:

a ground fabric formed with a knit fabric, wherein the knit fabric is obtained through warp knitting ground yarns; and pile yarns raised on the ground fabric, wherein the pile yarns slide on the supporting body or on the moving body, and wherein the pile yarns block flow of microscopic particles through the space between the moving body and the supporting body and collect the particles.

23. The sealing material according to claim 22, wherein a supporting layer made of cushioning material is located on the back surface of the ground fabric.

24. The sealing material according to claim 22, wherein a coating layer is located on the back surface of the ground fabric.

25. The sealing material according to claim 22, wherein the height of the pile yarns from the surface of the ground fabric is 0.5 to 5 mm.

26. The sealing material according to claim 22, wherein the ground fabric is knit in two sheets facing each other, wherein, after the pile yarns are knit with the two sheets to cross-link the sheets, the midsections of the pile yarns are cut between the sheets to form two sheets of the ground fabric, and wherein the pile yarns are raised on each sheet of the ground fabric.

27. The sealing material according to claim 22, wherein the pile yarns are knit with the ground fabric to form loops, and wherein the loops of the pile yarns are cut open so that the pile yarns are raised on the ground fabric.

28. The sealing material according to claim 27, wherein the angle of the pile yarns relative to the ground fabric is 1 to 45 degrees.

29. A method for manufacturing a sealing material attached to a moving body that contacts microscopic particles or to a supporting body facing the moving body, wherein the sealing material blocks flow of microscopic particles through the space between the moving body and the supporting body, the method comprising:

forming a ground fabric with a knit fabric, wherein the knit fabric is obtained through warp knitting ground yarns, wherein the ground fabric is knit in two sheets facing each other; and raising the pile yarns on each sheet of the ground fabric by knitting the pile yarns with the two sheets to cross-link the sheets, and cutting the midsections of the pile yarns between the sheets to form the two sheets of the ground fabric.

30. A method for manufacturing a sealing material attached to a moving body that contacts microscopic particles or to a supporting body facing the moving body, wherein the sealing material blocks flow of microscopic particles through the space between the moving body and the supporting body, the method comprising:

forming a ground fabric with a knit fabric, wherein the knit fabric is obtained through warp knitting ground yarns; and raising pile yarns on the ground fabric, wherein the pile yarns slide on the supporting body or on the moving body, and wherein the pile yarns block flow of microscopic particles through the space between the moving body and the supporting body and collect the particles.

31. The method according to claim 29, wherein, after being raised, the pile yarns are sheared such that the height of the pile yarns from the surface of the ground fabric is 0.5 to 5 mm.

* * * * *